United States Patent [19]

Schoeffl et al.

[11] Patent Number: 4,856,565

[45] Date of Patent: Aug. 15, 1989

[54] PROTECTIVE ENCLOSURE DEVICE FOR FILLING TANKS WITH COMPRESSED GAS

[75] Inventors: Manfred Schoeffl, Munich; Erich Lex, Weil/Schwabhausen, both of Fed. Rep. of Germany

[73] Assignee: Bauer-Kompressoren GmbH, Munich, Fed. Rep. of Germany

[21] Appl. No.: 85,746

[22] Filed: Aug. 14, 1987

[51] Int. Cl.[4] ..... B65B 1/04

[52] U.S. Cl. ..... 141/97; 141/18

[58] Field of Search ..... 141/1, 18, 94, 95, 96, 141/97, 311 R, 368, 369, 370, 371, 387; 220/315, 319

[56] References Cited

U.S. PATENT DOCUMENTS

| | | | |
|---|---|---|---|
| 870,103 | 11/1907 | Higginson | 141/97 |
| 2,462,575 | 2/1949 | Walker | 141/370 X |
| 3,219,228 | 11/1965 | Sorensen | 220/315 |
| 3,788,514 | 1/1974 | Giacoma, Jr. et al. | 220/89 A |
| 3,817,299 | 6/1974 | Koehler | 141/82 |
| 4,505,309 | 3/1985 | Adelman et al. | 141/97 |

*Primary Examiner*—J. R. Scott

*Attorney, Agent, or Firm*—Sixbey, Friedman, Leedom & Ferguson

[57] ABSTRACT

A protective enclosure device for filling tanks with compressed gas provides a cylindrical enclosure within which a tank may be placed and connected to a filling line, and which can, thereafter be closed by a closure arrangement that is equivalent in design to a cannon breech block from the standpoint of its ability to resist the explosive forces of an uncontrolled tank rupture. The walls of the enclosure are not only sufficiently thick to resist rupturing thereof, but are sufficiently heavy to absorb all of the dynamic reaction forces of an explosive tank rupture. Venting of the enclosure is provided at a rate which will prevent room over-pressurization and a resulting potential damaging of windows, doors, and other structures. The device is constructed to function in a fully automatic manner employing electromechanical and pneumatic devices.

23 Claims, 6 Drawing Sheets

FIG. 1
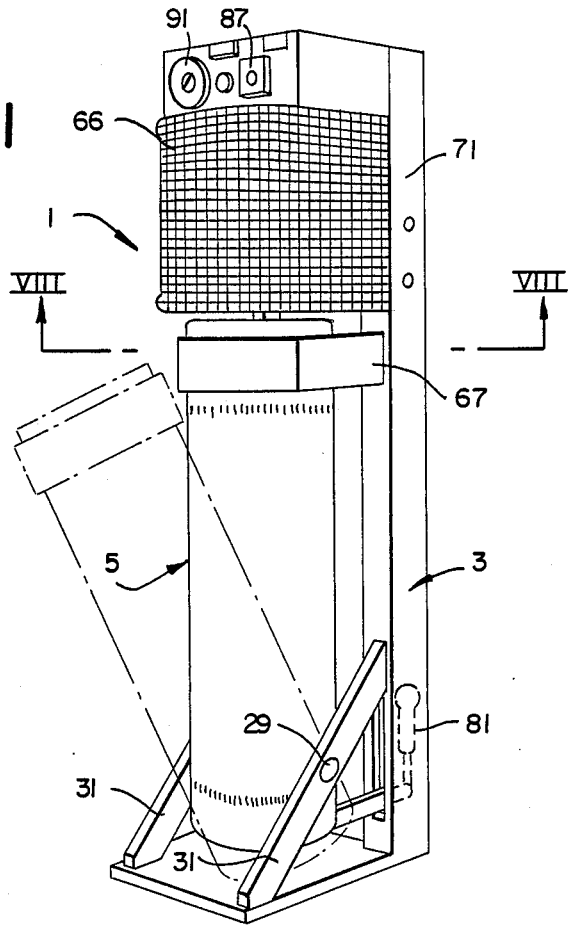
FIG. 2
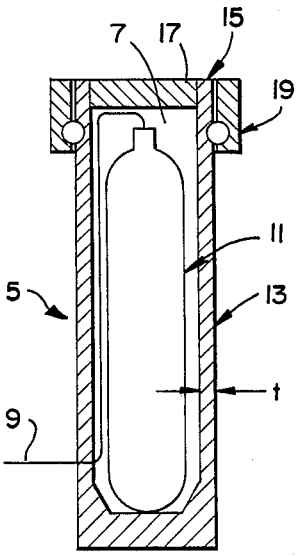
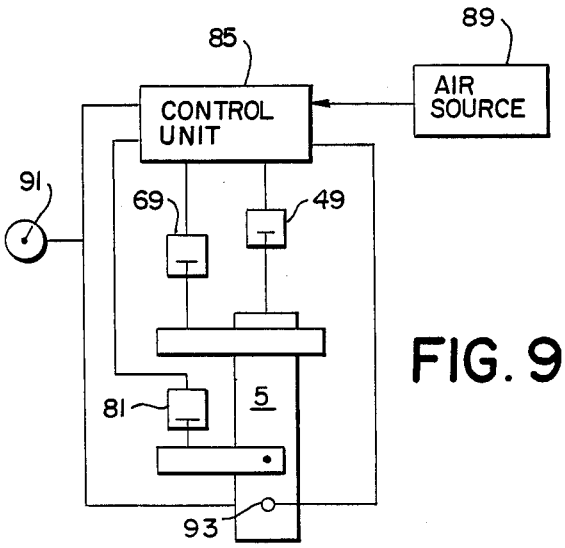
FIG. 9

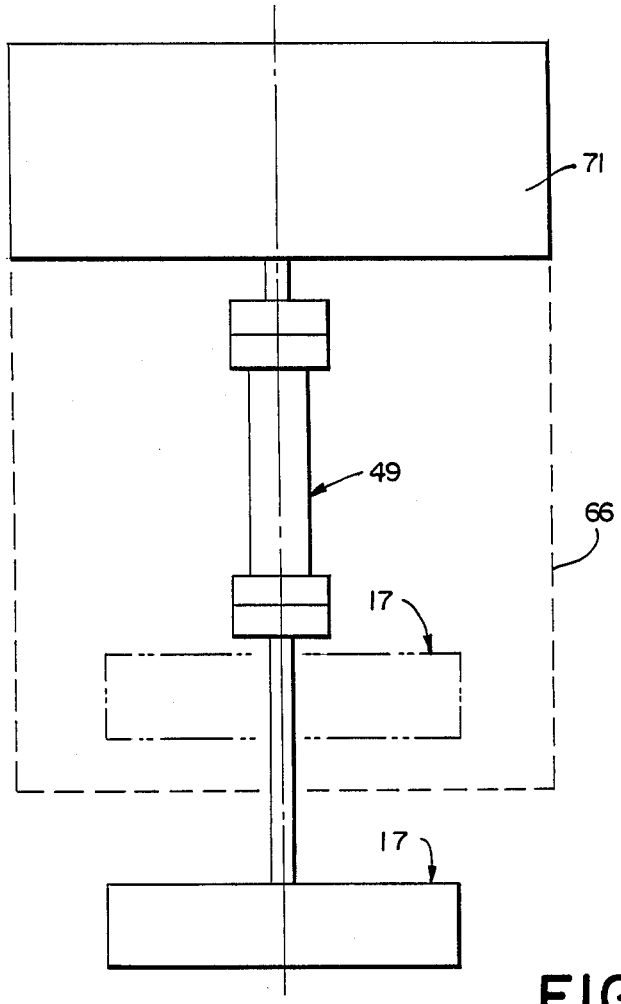
FIG. 7
FIG. 4
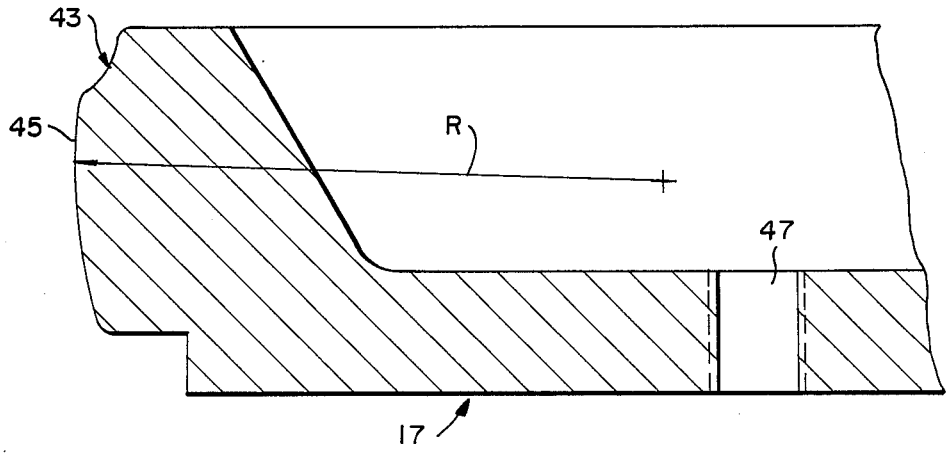

PROTECTIVE ENCLOSURE DEVICE FOR FILLING TANKS WITH COMPRESSED GAS

BACKGROUND OF THE INVENTION

1. Field of the Invention

The present invention is directed to a device providing a protective enclosure within which tanks, such as those used for breathing apparatus, may be filled with a gas, such as air. In particular, the invention is directed to such a device which will not only provide maximum safety for all persons in the area of the device, in the event of an uncontrolled tank rupture during filling, but will also contain the forces generated by the blast of a high pressure cylinder to an extent sufficient to avoid potentially adverse effects which could result from a substantially free discharge of the rapidly expanding gases and sound burst which accompany a tank rupture.

2. Description of Related Art

Filling of tanks with gases of up to 350 bar (5,075 psig) can be extremely dangerous because of the hazard of explosion. The hazards comprise direct physical injury to persons in the surrounding area, such as from flying shrapnel produced by the exploding tank, and indirect hazards posed by the rapid discharge of expanding gas and the sound burst produced which can, for example, produce breakage of nearby windows. A device directed to the solution of this problem is disclosed in U.S. Pat. No. 3,817,299. However, the expansive gas protective device of this patent involves the use of a heavy wall cylindrical vessel having a door at its lower extremity through which a number of tanks, such as SCUBA diving tanks, may be placed into the vessel. The upper extremity of the vessel passes through the roof of the building within which the vessel is located to a terminus in the form of an open end of the vessel that is disposed above the roof and across which a gridwork of rods extends for preventing the escape of flying tanks and most debris to the surrounding environment. As a result, this vessel must be constructed in situ and requires modifications to the building structure within which it is to be housed. The lack of transportability of the completed, operational device and the need to implement building modifications to house it are both significant disadvantages.

U.S. Pat. No. 4,505,309 discloses an apparatus for inflating pneumatic tires on vehicular wheel rims that comprises a box that receives a tire-carrying wheel rim. The box has walls (for surrounding the tire-carrying wheel rim, on all sides and at the top and bottom) that are formed, for example, of at least one-quarter inch thick steel plates that are welded together to be sufficiently strong to contain all tire and wheel parts in the event that the tire explodes. Furthermore, one wall of the box serves a door that is openable to permit the introduction and removal of the tire-carrying wheel rim and, for example, a 1/16th inch gap extends all around the door so that a total leakage area of at least about 20 square inches will exist for the harmless escape of air from the box when a tire in the box explodes. For tire inflation purposes, a flexible air conduit is provided within the box that has an outlet connector that can be clamped to a tire valve stem and which has linking means that penetrates through a wall of the box to a valve supply line outside the box and to a pressure indicator which will indicate the pressure in the tire from outside of the box. While the device of this patent may be more than adequate to prevent damage from occurring as a result of a tire exploding during inflation, such an apparatus would not eliminate hazards associated with charging of compressed gas tanks from several standpoints.

Firstly, since compressed gas tanks are charged up to pressures of at least 100 to 500 times that used for inflating a tire, the strength of the walls, of which the enclosure of U.S. Pat. No. 4,505,309 is formed, would be inadequate to safely resist the force of an exploding tank of highly pressurized gases. Furthermore, even if the walls did not rupture, the device as a whole lacks sufficient mass to prevent the apparatus from "jumping" under the forces of the explosion in a manner producing injury to a person or damage to anything upon which the apparatus lands. Still further, an air gap of the magnitude disclosed in this patent is such that, in the event of an explosive rupturing of a pressurized gas tank within the enclosure, the rate at which the expanding gases will be discharged from the enclosure would increase the ambient pressure of the room sufficiently to damage its windows, doors and/or roof, and the same would apply to the discharge of a potentially hazardous sound burst from the explosion.

Another type of explosion relief device is known for use with large vessels of the type requiring full vessel diameter venting, wherein the force of an explosion occurring within the vessel causes a removable head or hatch cover to move away from the vessel to allow the compressed gases produced by the explosion to escape through the, now open, top without damaging other parts of the vessel. Such vessels are used for a wide variety of functions, e.g., a reactor, separator, storage tank, bin, container, hopper, surge tank, etc., and an example of a vessel having an explosive relief cover can be found in U.S. Pat. No. 3,788,514. However, since full vessel diameter venting is used to minimize the necessary pressure rating of a vessel, i.e., to reduce the thickness of the vessel wall to the greatest extent while still enabling it to meet desired safety standards, if applied to an enclosure that is small enough to be transportable, the enclosure would lack sufficient mass to preclude the above-noted jumping phenomenon and the rapid discharge of pressure out of the full diameter of the vessel, during venting, would lead to the above-noted problem of, for example, windows being blown out due to an increase in ambient room pressure.

Accordingly, there is a need for a protective enclosure device for filling of tanks with compressed gas which is sufficiently compact to be transportable in a fully assembled operable state, requires no modifications to building structure in order to enable its use, and which will sufficiently contain the effects of an uncontrolled tank rupture within the device so as to avoid any damage to persons and objects in its vicinity.

SUMMARY OF THE INVENTION

In view of the foregoing, it is a primary object of the present invention to provide a protective enclosure device for filling tanks with compressed gas which will provide the best technically possible safety conditions.

It is a further object of the present invention to provide an enclosure device for filling tanks with compressed gas which will provide an escape path for the expanding gases from the explosion which will prevent dangerous dynamic reactions.

Yet another object of the present invention is to provide a protective enclosure device for filling tanks with compressed gas which functions in a fully automatic manner employing electromechanical and pneumatic devices.

It is a specific object of the present invention to provide a cylindrical enclosure that is capable of withstanding the forces generated during an uncontrolled rupture of tanks with gases up to 350 bar (5,000 psig) without wall failure, and which has a cover which not only will remain securely locked in place despite the rupture of a tank within the enclosure, but will also provide a controlled venting of the interior of the enclosure.

The above objects and others are achieved in accordance with a preferred embodiment of the present invention which provides a cylindrical enclosure within which a tank may be placed and connected to a filling line, and which can, thereafter, be closed by a closure arrangement that is equivalent in design to a cannon breech block from the standpoint of its ability to resist the explosive forces of an uncontrolled tank rupture. The closure arrangement is comprised of an inner closure plug and an actuating member formed by an outer sleeve. The closure plug and actuating member are displaceable relative to the cylindrical enclosure and each other by way of piston-cylinder units. A plurality of ball members form locking elements that are shiftable, through apertures in the enclosure, by the outer sleeve, between a position securing the closure plug within the cylindrical enclosure and one enabling the plug to be completely withdrawn from the cylindrical enclosure. In the closed position, a clearance gap is provided between the periphery of the closure plug and the inner circumference of the cylindrical enclosure to provide a controlled venting of the interior space of the enclosure in the event of a tank rupture, which will not create such an increase in ambient pressure as to result in, for example, windows in the vicinity of the device being broken.

To provide sufficient mass to prevent the device, as a whole, from jumping under the effect of a tank explosion, the thickness of the cylindrical enclosure is increased, by a factor of at least two, beyond that necessary to safely contain a tank explosion, so as to afford the necessary mass to prevent jumping of the device under an explosion's effect. A pair of piston-cylinder units are provided for swinging the enclosure between a loading position and a closure and filling position. Furthermore, a pressure sensor is incorporated into the cylindrical enclosure which will shut down the device in response to a tank rupture.

These and further objects, features and advantages of the present invention will become more obvious from the following description when taken in connection with the accompanying drawings which show, for purposes of illustration only, a single embodiment in accordance with the present invention.

BRIEF DESCRIPTION OF THE DRAWINGS

FIG. 1 is a front perspective view of a protective enclosure device in accordance with a preferred embodiment of the present invention;

FIG. 2 is a diagrammatic sectional view of an enclosure of the enclosure device of FIG. 1 showing a tank in place for filling;

FIG. 4 is a partial sectional view of a closure plug forming part of the closure for the enclosure;

FIG. 7 is a diagrammatic illustration of the closure plug displacing mechanism of the device of FIG. 1;

FIG. 9 is a schematic depiction of the control system of the device of FIG. 1.

DETAILED DESCRIPTION OF THE PREFERRED EMBODIMENT

Figure 3:
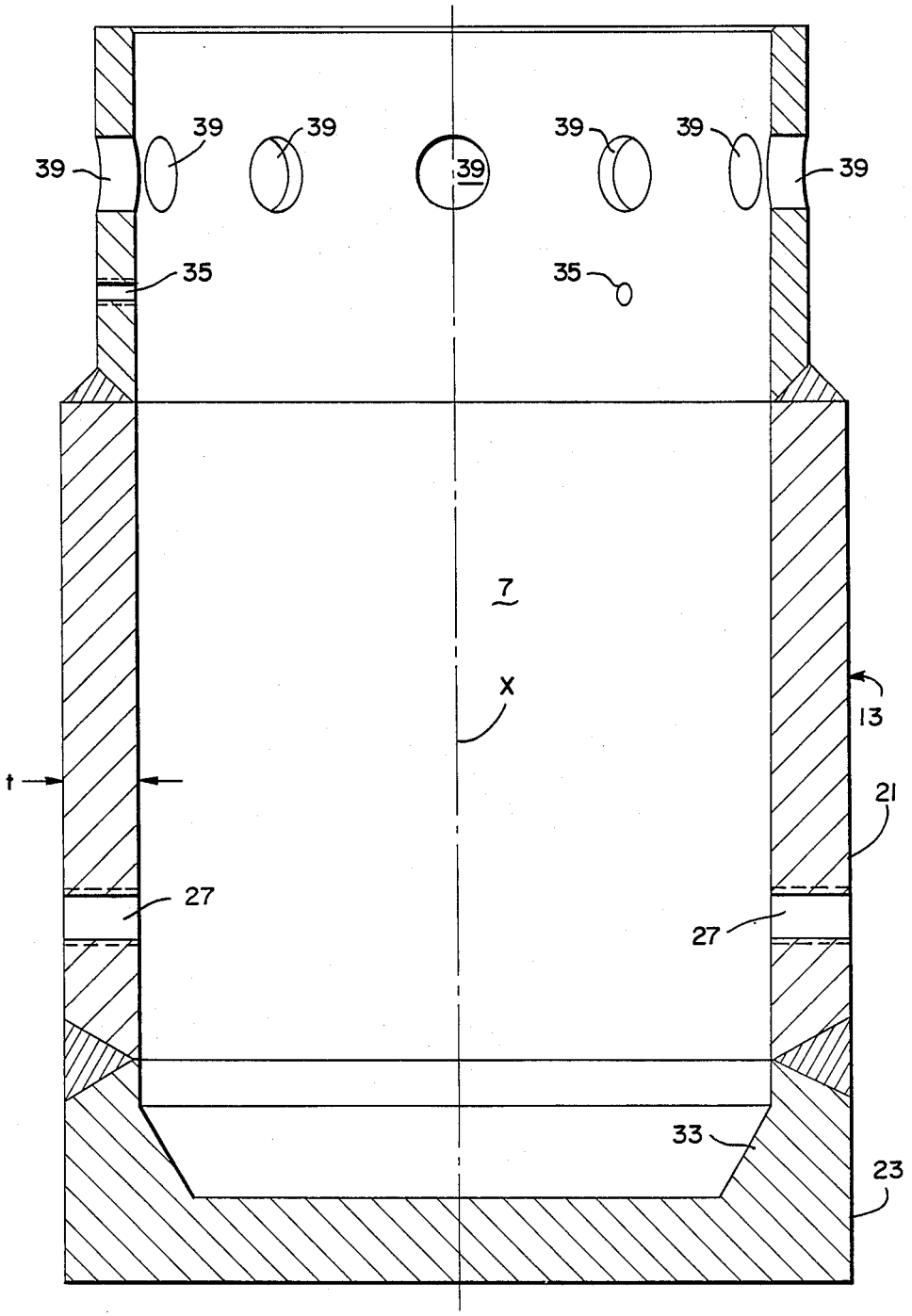
FIG. 3 is a cross-sectional view of the cylindrical body member of the enclosure shown in FIG. 1 and 2.

With reference to FIG. 1, a protective enclosure device 1 for filling tanks (also known as bottles) with compressed gas is shown as having two primary components, a stand designated generally by the reference numeral 3 and a protective enclosure designated generally by the reference numeral 5. As depicted in FIG. 2, enclosure 5 defines a receiving space 7 for a tank 11 to be filled with a highly pressurized gas, such as the air tanks used for breathing apparatus worn by SCUBA divers, firemen, etc. A pneumatic line 9 extends, via a conventional high pressure fitting, through the wall of enclosure 5 in order to provide a fill hose with a fill valve within the receiving space 7 for connection to tank 11. Enclosure 5, itself, is formed of a cylindrical body member 13 which defines the receiving space 7, and a closure means 15 for the cylindrical body member that is provided by a two-part closure having a closure plug 17 and a locking means 19.

The cylindrical body member 13 is shown in greater detail in FIG. 3 as being formed from a thick walled pipe section 21 that is welded at opposite ends to a base member 23 and a thinner walled section of tubing 25. Section 21 is provided with an opposed pair of threaded openings 27 for receiving a bolt 29 (only one of which is shown in FIG. 1) that is used for pivotally mounting the enclosure 5 to the diagonal braces 31 of the stand 3 for reasons which will be explained in further detail below. Section 21 is also provided with an opening for the pressure fitting for the filling 9, which is not shown. In the illustrated, preferred version, the weakest portion of the cylindrical body member (the lower corner region) is strengthened by a bevelled thickening of the wall indicated at 33. Lastly, section 25 is provided with at least three symmetrically disposed threaded openings 35 for receiving stop bolts 37 (FIGS. 5 and 6) and a plurality (for example 10) of radial openings 39 for receiving locking members in the form of balls 41.

The closure plug 17 of the closure means 15 has an annular arcuate surface 43 having a curvature matched to that of the balls 41 and a larger, convexly curved, lower peripheral wall surface 45 having a radius of curvature R which is designed to prevent misalignment and binding so as to assure that the plug will seat properly within the open upper end of cylindrical body member 13. Additionally, a centrally disposed, threaded axial bore 47 is provided for use in connecting the closure plug 17 with the piston rod of a pneumatic piston-cylinder unit 49 (FIG. 7).

Figure 5:
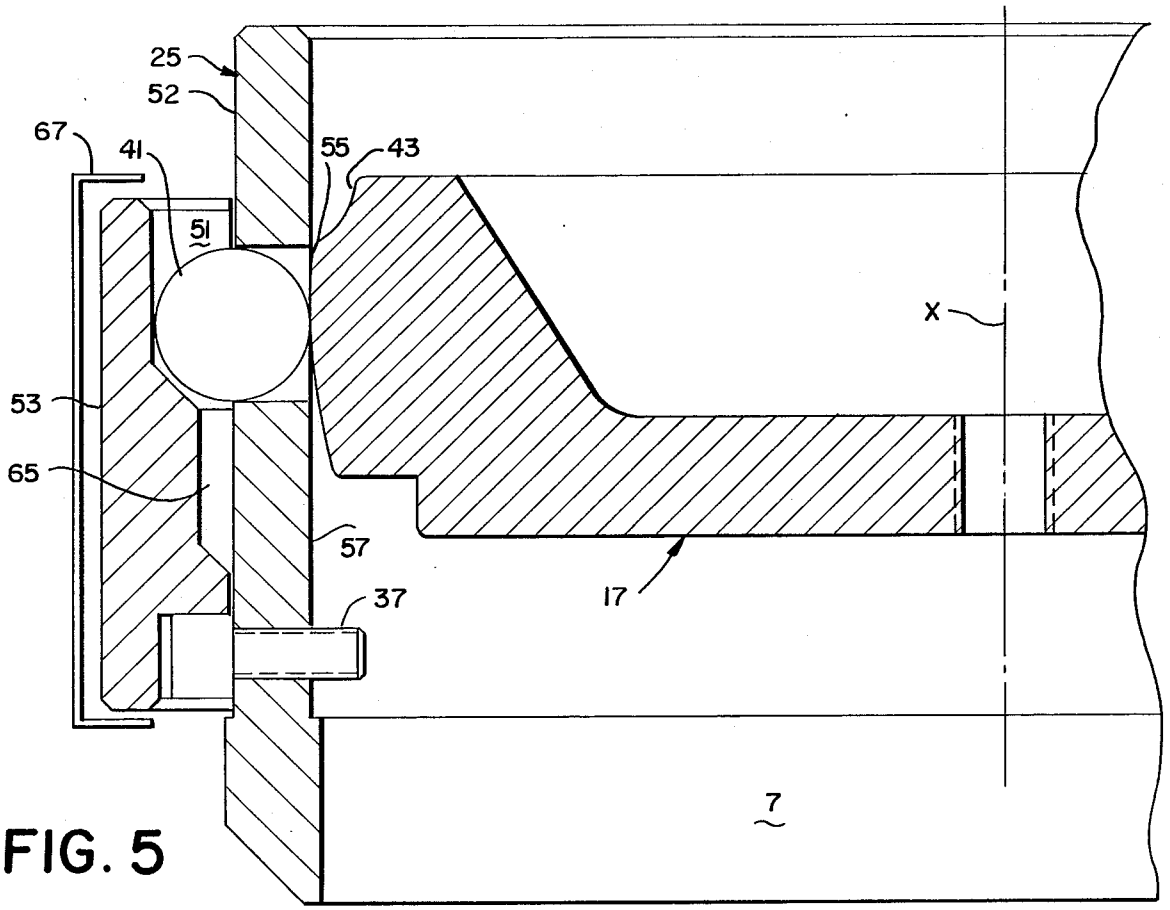
FIG. 5 is a sectional view of a top portion of the enclosure of the FIG. 1 device just prior to closure and locking thereof.

FIG. 5 shows the plug 17 at its position within the upper section 25 of the enclosure 13 which is obtained just prior to closure and locking of the cylindrical enclosure 13 thereby. A this point in time, the locking members formed by the balls 41 have been shifted out of the opening of the body member 13 to a position within inner, annular recess 51 of the ring forming the actuating member 53 of the locking means 19. Recess 51 has a diameter that is larger than that of the peripheral outer surface 52 of the section 25 by an amount greater than the radius of the balls 41 so as to ensure that the balls 41 will stay in their FIG. 5 position of their own accord, but to ensure that the balls do not fall out into receiving space 7, when the closure plug 17 is withdrawn out of the body member, a retaining lip 55 is formed about the openings 39 at the inner surface of section 25 of body member 13 to reduce the diameter of openings 39 to less than that of balls 41. Furthermore, the recess 51 is dimensioned to be deep enough to ensure that, in the FIG. 5 position, the balls 41 are withdrawn through the openings 39 to a sufficient extent not to project out of the holes beyond the inner wall surface 57. In the disengaged position of the locking means shown in FIG. 5, the actuating member 53 is engaged upon the head of stop bolt 37.

Figure 6:
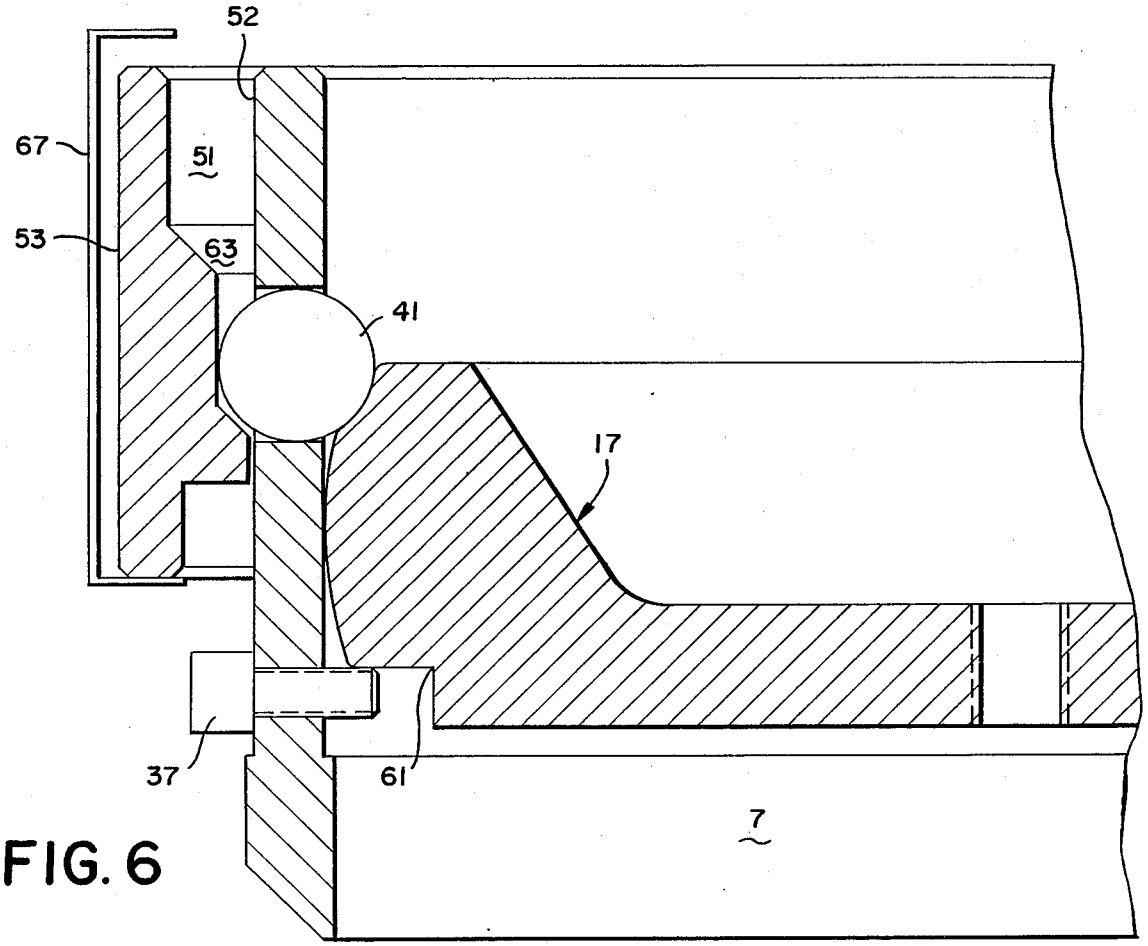
FIG. 6 is a sectional view of a top portion of the enclosure of the device of FIG. 1, similar to FIG. 5, but in a closed and locked condition.

Once closure plug 17 has been fully lowered into its closure position, at which the shaft of stop bolt 37 engages a notched portion 61 at the lower corner of closure plug 17, actuating member 53 is shifted upwardly into the FIG. 6 position, whereby camming surface 63 pushes the balls 41 inwardly through the openings 39. Cam surface 63 connects with a lower recess 65 wherein the outermost portion of the ball is held in the illustrated locking position. The depth of recess 65 is set so that the balls 41 will securely engage the arcuate surface 43 of the closure plug 17 to hold it in place within the open end of body member 13.

Figure 8:
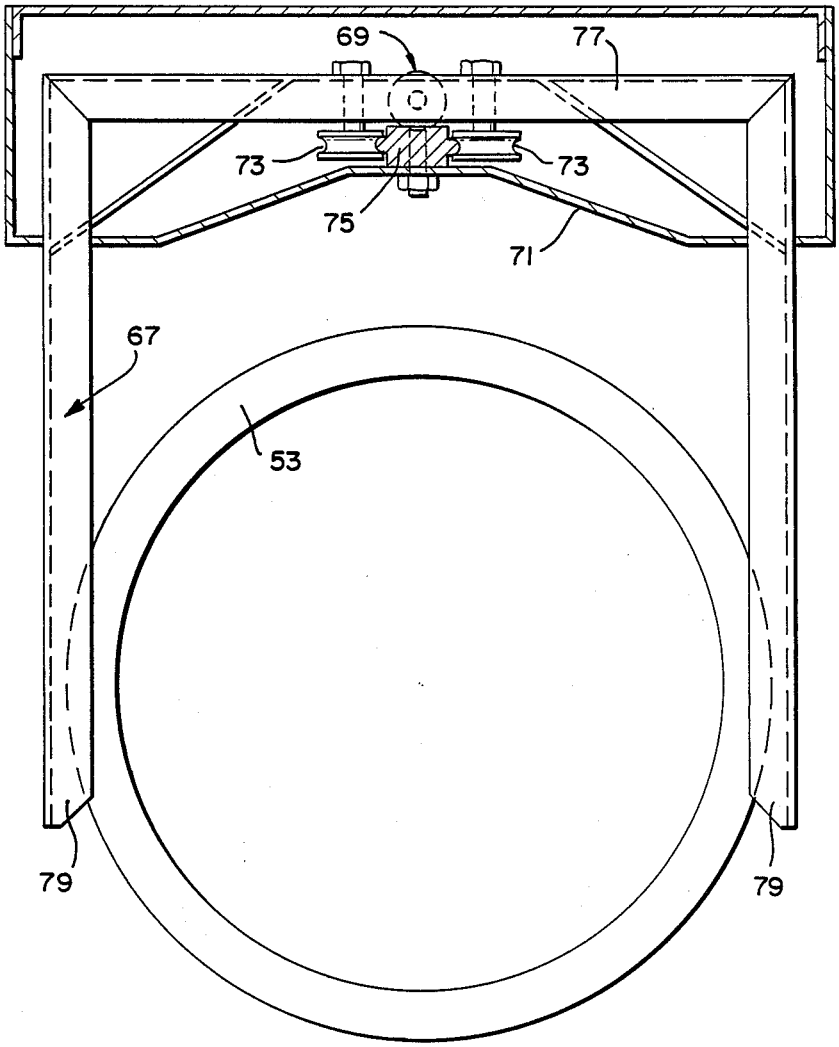
FIG. 8 is a sectional view taken along VIII—VIII in FIG. 1.

The pneumatic piston cylinder unit for reciprocating the closure plug 17 into and out of the cylindrical body member 13 is housed behind a protective screen 66 that is carried by the stand 3 as shown in FIGS. 1 and 7. The actuating member 53 is reciprocated between the positions of FIGS. 5 and 6 by a C-shaped bracket 67 formed of C-shaped channel sections via a second pneumatic piston-cylinder unit 69 (FIG. 8). The bracket 67 is mounted for vertical raising and lowering to the stanchion 71 of the stand 3 via a pair of rollers 73 which move along a vertical track member 75 that is bolted to a vertical wall of the stanchion 71 internally thereof. The piston-cylinder unit 69 is interconnected between the stanchion 71 and the center section 77, while the cantilevered legs 79 of the bracket 67 receive the actuating member 53 between top and bottom surfaces of the channel section of which it is formed. Thus, extension and retraction of the piston-cylinder unit 69 causes the bracket 67 to move up and down along the track 75 to an extent sufficient to cause the legs 79 to engage respective facing surfaces of the actuating member 53 and to carry the actuating member up and down between the FIG. 5 and FIG. 6 positions.

As noted above, the enclosure 5 is pivotally mounted to stand 3. To achieve this pivoting movement, a pair of further pneumatic piston-cylinder units 81 (one of which is depicted in FIG. 1) are housed within stanchion 71 of stand 3, and each is connected via link 83 to the enclosure 5, so that upon extension and retraction of the piston-cylinder units 81 the links are displaced so as to swing the enclosure from the filling position (shown in solid lines in FIG. 1) to a loading and unloading position (shown in phantom outline in FIG. 1) where the opening of the cylindrical body 13 has been swung clear of the screened-in overhead portion of stand 3 to provide free access for insertion and removal of the tank 11. The distance between the top and bottom flanges of the channel legs 79 is selected to provide sufficient clearance so that they permit the actuating member 53 to swing freely in and out of the bracket as enclosure 5 is pivoted.

Operation of all of the piston-cylinder units 49, 69, 81, and filling of the tank 11, is controlled by a single control unit 85 via a single selector switch 87. For example, by turning the switch to a first position, the piston-cylinder unit 49 will withdraw the closure plug 17 from the cylindrical body member 13. After withdrawal of the closure plug, turning of the switch to the next position can cause pneumatic piston-cylinder unit 69 to swing the enclosure body out into the phantom line position of FIG. 1, at which point a tank can be loaded/unloaded and the fill line connected/disconnected. The switch 87 can be turned back to its original position thereby retuning the closure to an upright closed position due to reverse direction movement of the piston-cylinder units 49, and 81. Once back in its upright, closed position, the selector switch 87 can be turned in the opposite direction to cause piston-cylinder unit 69 to lock the closure plug, and then to commence a flow of air from a high pressure air source 87 (which may be a separate compressor or storage tank) to be supplied via line 9 to the tank 11 and the pressure within the tank 11 can be monitored via a pressure gauge 91. However, should rupturing of tank 11 occur, a pressure increase within the receiving space 7 indicative of such an event, can be monitored by a pressure sensor 93 mounted in enclosure 5. As a result of receipt of a signal from the pressure sensor 93, control unit 85 is caused to shut down operation of the device 1, and particularly to disconnect the air source 89 from filling line 9. Additionally, limit switches can be used to monitor each step of the above-described operation so that the device will be shut down in the event of a potentially hazard malfunction at any point. For example, if a limit switch fails to detect extension of piston-cylinder unit 69 sufficiently to lock closure plug 17, airflow to the tank 11 will not be commenced.

To ensure that the enclosure 5 is able to sustain the effects of an uncontrolled explosive rupturing of a tank 11 within the enclosure 5, formulas are readily available to determine a suitable thickness t for the enclosure walls. For example, A.S.M.E. Boiler and Pressure Vessel Code, Section VIII, Div. 1. Paragraph U.G.-27, Thickness of Shells Under Internal Pressure, and AD-Merkblatt, B0, B1, B10, the German standard for pressure vessel design, may be used. However, it has been found that an enclosure 5 constructed of walls with a thickness determined by such standards will lack sufficient mass to absorb all of the dynamic forces occurring in an uncontrolled rupture, such as the force of the tank or tank parts impacting thereagainst. As a result, forces that are not absorbed are transferred to the stand 3, which can be damaged thereby, and the device 1, as a whole, can be caused to "jump" or tip over, injuring or damaging persons or things nearby. On the other hand, it has been found that all of the dynamic forces can be absorbed by the enclosure 5 if the wall thickness is suitably increased to provide an adequate mass. This can be achieved by providing a wall thickness t that is at least twice the thickness determined in accordance with the noted A.S.M.E. Boiler and Pressure Code standard, or at least 2.1 times the noted German standard. Alternatively, a suitable mass for absorbing all reaction forces of an uncontrolled explosive rupturing of a tank 11 within the enclosure 5 can be achieved by providing the cylindrical body member 13 with a mass of about at least 20 times the weight of any tank that would be receivable for filling within the enclosed receiving space 7.

In addition to providing the enclosure 5 with sufficient strength and mass, it is important to provide a means for bleeding off the high pressure gases released into the receiving space 7 upon rupturing of a tank 11 that has been filled with gases at pressures up to 350 bar (5075 psi). If air under such pressures were released into any normal sized room, the force resulting from the increase in ambient pressure would easily blow out any windows in the room, at a minimum. To solve this problem, in the illustrated embodiment, the receiving space 7 has been given a volume that is about three times that of tanks which the device 1 is designed to fill, and a clearance gap has been provided between the periphery of the closure plug 17 and the facing inner wall surface of the cylindrical body member 13 that is sized to provide a maximum flow-through area of approximately 0.002 square feet (2.88 square inches). For example, if the inner diameter of section 25 is 227 mm, a clearance gap 0.15 mm±0.05 mm would be suitable.

Of course, it should be appreciated that instead of providing venting through a clearance gap between the closure plug 17 and the cylindrical body member 13, venting may be provided via one or more openings in the closure plug or walls of the body member. In this connection, it is noted that whatever type of venting means is used, the outflowing of expanding gases from the receiving space 7 should be controlled to a maximum escape rate in a range of 50–100 cu. ft./min., as is achieved with the illustrated embodiment during uncontrolled rupturing within the receiving space 7 of a tank 11 containing gases at pressures up to 350 bar. Such a flow rate is equivalent to that produced by a typical bathroom or kitchen ventilating exhaust fan and will not result in a potentially damaging increase in pressure if the device is used in a room of typical dimensions, such as, for example, a room having 8 foot ceilings and a length and width of 10 feet.

Inasmuch as a jet of escaping gases being vented from the receiving space 7 can produce a destabilizing force which could cause the device 1, as a whole, to tip over, it is desirable that any vent arrangement used be disposed symmetrically with respect to the central longitudinal axis X of the enclosure 5. Furthermore, a vertically upwardly issuing direction for the venting gases is particularly desirable in that the force of the venting gases will act to hold down the device. Lastly, with regard to venting of the enclosure 5, care should be taken to avoid designing a vent opening in a way that would enable tank fragments to plug the vent opening or escape from the enclosure 5 therefrom.

From the foregoing, it should now be seen how the present invention provides a protective enclosure device for filling of tanks with compressed gas which will enable filling thereof to be carried out under the best technically possible safety conditions, in a simple and efficient manner.

While we have shown and described a single embodiment in accordance with the present invention, it is understood that the same is not limited thereto, but is susceptible of numerous changes and modifications as known to those skilled in the art, and we, therefore, do not wish to be limited to the details shown and described herein, but intend to cover all such changes and modifications as are encompassed by the scope of the appended claims.

We claim:

1. Protective enclosure device for filling tanks with compressed gas comprising a cylindrical body member defining a receiving space for a tank to be filled with highly pressurized gas, said cylindrical body member having an opening at one end through which said tank to be filled is insertable into said receiving space; closure means for closing said opening comprising a closure plug and locking means for securing said closure plug within said opening; and supply means extending through said body member for connecting a tank enclosed within said receiving space with a source of pressurized gas outside of said body member; wherein said cylindrical body member has a wall thickness sufficient to prevent rupturing thereof and to provide sufficient overall mass to prevent jumping thereof during uncontrolled rupturing within said receiving space of a tank containing gases pressurized up to 350 bar; and wherein said enclosure device is provided with vent means for venting of gases, released during said uncontrolled rupturing, from said receiving space at a controlled escape rate which will prevent damaging pressure increases in the environment surrounding said body member.

2. Protective enclosure device according to claim 1, wherein said locking means comprises a reciprocable actuating member and a plurality of locking members, said actuating member being shiftable between a first position wherein said locking members are shifted into said opening of the body member in a manner blocking withdrawal of said closure plug from said opening and a second position enabling said locking members to shift out of said opening to permit egress of said closure plug from said opening.

3. Protective enclosure device according to claim 2, wherein said actuating member is a ring surrounding said one end of the cylindrical body member and having a camming surface on a side thereof facing said body member, and wherein said locking members are cam followers, each of which is received within a respective radial opening extending through said one end of the body member.

4. Protective enclosure device according to claim 3, wherein said locking members are balls which engage an arcuate surface formed on the periphery of said closure plug when said actuating member is in said second position.

5. Protective enclosure device according to claim 1, wherein said venting means is formed by a circumferential clearance gap between the periphery of said closure plug and an inner wall surface of the cylindrical body member.

6. Protective enclosure device according to claim 5, wherein said receiving space is provided with a volume that is about three times that of a tank to be filled therein and the clearance gap is sized to provide a maximum 0.002 sq. ft. flow-through area.

7. Protective enclosure device according to claim 2, wherein said closure plug has an axial curvature to provide an alignment surface for facilitating insertion of the closure plug into the opening of the cylindrical body member.

8. Protective enclosure device according to claim 2, wherein said cylindrical body member is mounted upon a stand having first means for shifting said closure plug between a closure position within the opening of the body member and an open position withdrawn from said opening, and having second means for shifting said actuating member between its first and second positions.

9. Protective enclosure device according to claim 8, wherein said cylindrical body member is pivotally carried by said stand and is swingable between a swung-out position for loading and unloading of a tank from said receiving space, and a vertically oriented position for filling of a tank enclosed within said receiving space.

10. Protective enclosure device according to claim 9, wherein said first means comprises a first piston-cylinder unit connected between said stand and said closure plug, said second means comprising a bracket and a second piston-cylinder unit, and wherein said actuating member is shifted into and out of said bracket as the cylindrical body member is swung into and out of its tank filling position.

11. Protective enclosure device according to claim 10, wherein means for producing the swinging of said enclosure unit is carried by said stand and includes at least one piston-cylinder unit.

12. Protective enclosure device according to claim 11, comprising control means for controlling operation of all of said piston-cylinder units and filling of a tank enclosed within said receiving space.

13. Protective enclosure device according to claim 12, wherein a pressure detector is provided for detecting an increase in pressure within said receiving space indicative of a tank rupture and for producing a signal in response thereto, and wherein said control means is operative to terminate operation of the device in response to said signal.

14. Protective device according to claim 1, wherein said wall thickness is at least twice the thickness determined in accordance with A.S.M.E. Boiler and Pressure Code Section VIII, Div. 1, paragraph UG-27 for the thickness of shells under pressure.

15. Protective device according to claim 1, wherein the cylindrical body member is provided with a mass of about at least 20 times the weight of any tank receivable in said receiving space for absorbing all reaction forces produced by rupturing of the tank.

16. Protective enclosure device for filling tanks with compressed gas comprising a heavy walled cylindrical body member defining a receiving space for a tank to be filled with highly pressurized gas, said cylindrical body member having an opening at one end through which said tank to be filled is insertable into said receiving space; closure means for closing said opening comprising a closure plug and locking means for securing said closure plug within said opening; and supply means extending through said body member for connecting a tank enclosed within said receiving space with a source of pressurized gas outside of said body member; wherein said cylindrical body member is mounted upon a stand having first means for shifting said closure plug between a closure position within the opening of the body member and an open position withdrawn from said opening, and having second means for shifting said locking means between a locking position securing said closure plug within said opening and an unlocking position permitting egress of said closure plug from said opening.

17. Protective enclosure device according to claim 16, wherein said cylindrical body member is pivotally carried by said stand and is swingable between a swung-out position for loading and unloading of a tank from said receiving space, and a vertically oriented position for filling of a tank enclosed within said receiving space.

18. Protective enclosure device according to claim 17, wherein said first means comprises a first piston-cylinder unit connected between said stand and said closure plug, said second means comprising a bracket and a second piston-cylinder unit, and wherein an actuating member of the locking means is shifted into and out of said bracket as the cylindrical body member is swung into and out of its tank filling position.

19. Protective enclosure device according to claim 18, wherein means for producing the swinging of said enclosure unit is carried by said stand and includes at least one piston-cylinder unit.

20. Protective enclosure device according to claim 19, comprising control means for controlling operation of all of said piston-cylinder units and filling of a tank enclosed within said receiving space.

21. Protective enclosure device according to claim 20, wherein a pressure detector is provided for detecting an increase in pressure within said receiving space indicative of a tank rupture and for producing a signal in response thereto, and wherein said control means is operative to terminate operation of the device in response to said signal.

22. Protective enclosure device for filling tanks with compressed gas comprising a heavy walled cylindrical body member defining a receiving space for a tank to be filled with highly pressurized gas, said cylindrical body member having an opening at one end through which said tank to be filled is insertable into said receiving space; closure means for closing said opening comprising a closure plug and locking means for securing said closure plug within said opening; and supply means extending through said body member for connecting a tank enclosed within said receiving space with a source of pressurized gas outside of said body member; wherein said enclosure device is provided with vent means that is disposed symmetrically with respect to a central longitudinal axis thereof, said vent means being operable to produce a controlled maximum escape rate of gases, released during uncontrolled rupturing within said receiving space of a tank containing gases at pressures up to 350 bar, in a range of 50–100 cu. ft./min.

23. Protective enclosure device according to claim 22, wherein a clearance gap is provided, between said closure plug and an inner wall surface of the cylindrical body member when said closure plug is secured within the opening of the body member, as said vent means.

* * * * *